United States Patent [19]

McClish

[11] Patent Number: 4,903,566

[45] Date of Patent: Feb. 27, 1990

[54] COMPOSITE PICKUP APPARATUS FOR STRINGED INSTRUMENTS

[76] Inventor: Richard E. D. McClish, 2200 Chapdelaine, apt. 1203, Ste-Foy, Quebec, Canada, G1V 4G8

[21] Appl. No.: 159,260

[22] Filed: Feb. 23, 1988

[51] Int. Cl.[4] ..... G10H 3/00

[52] U.S. Cl. ..... 84/734; 84/DIG. 24

[58] Field of Search ..... 84/1.16, 1.14, DIG. 24, 84/1.04, 1.06

[56] References Cited

U.S. PATENT DOCUMENTS

| | | | |
|---|---|---|---|
| 3,073,203 | 1/1963 | Evans | 84/1.16 |
| 3,453,920 | 7/1969 | Scherer | 84/DIG. 24 X |
| 4,248,120 | 2/1981 | Dickson | 84/1.16 |

FOREIGN PATENT DOCUMENTS

| | | | |
|---|---|---|---|
| 3528991 | 2/1987 | Fed. Rep. of Germany | 84/1.16 |

*Primary Examiner*—A. T. Grimley
*Assistant Examiner*—Matthew S. Smith

[57] ABSTRACT

A pickup for a string under tension of a musical instrument having an improved planar response uses a pair of mechanically independent pressure transducers preferably adjacent to one another which provide independent support to transversely adjacent points of the string. The independent transducers allow the string to roll slightly on one transducer when applying pressure to the other as a result of the string vibration, thus increasing the sensitivity of the pickup in planes near the plane of minimum sensitivity. The transducers may rest on a common massive element which is resiliently coupled to the bridge of the instrument. The transducers preferably have rounded string-contacting surfaces in order to reduce the magnitude of the shear forces exerted on the pickup when the string tension is varied.

8 Claims, 2 Drawing Sheets

COMPOSITE PICKUP APPARATUS FOR STRINGED INSTRUMENTS

TECHNICAL FIELD

The present invention relates to musical instruments and more specifically to electrically amplified stringed instruments.

BACKGROUND ART

Contact pickups are commonly used in connection with stringed musical instruments, especially in the bridge of electrically amplified acoustic guitars. The most versatile configuration for a bridge pickup is that which produces independent string signals. This allows the sound of each string to be individually processed and also allows the instrument thus monitored to control a second instrument such as a music synthesizer.

U.S. Pat. No. 3,453,920 issued to Scherer exemplifies a contact pickup for an instrument string in which the string support is fixed to and supported by two transducer elements disposed to respond respectively to different planes of vibration.

A first problem exists in such a pickup when the transducer elements do not lie in a common plane, that the bottom faces of the string support must mate well with the contacting faces of the supporting transducer elements in order to distribute the applied pressures evenly over the entire area of both transducer elements. Since it is not preferable to have thick bond lines between the parts for reasons of solidity as well as transduction preformance, this configuration imposes strict dimensional and angular tolerances upon the parts comprising the assembly, which tends to increase the cost of manufacture of such a pickup.

A second problem exists in such an arrangement of parts, that when the vibrating string applies pressure to one transducer element, it must also exert shear forces on the other element. This reduces the transduction efficiency of the pickup especially when the transducer elements are relatively compliant or when the string support is made of a very hard and unyelding material.

It is therefore a broad object of the present invention to provide a pickup for an instrument string having multiple transducer elements responding maximally in different planes of vibration and in which the shear forces applied to the transducer elements by the string vibrations are significantly reduced.

It is a more specific object of the present invention to provide a pickup having high sensitivity in virtually all planes of vibration of the contacting string.

It is a further object of the present invention to provide a pickup having the above-mentioned enhancements and which is more economical to manufacture than corresponding pickups in the prior art.

SUMMARY OF THE INVENTION

This invention is a pickup for the string of a stringed instrument that transduces the vibrations of the string to strong electrical signals that are characteristic of those vibrations both in amplitude and in frequency in virtually all planes of vibration. The pickup of this invention is composed of two separate and preferably identical halves juxtaposed symmetrically under the contacting string so as to define one end of the vibrating portion thereof.

Each half of the pickup is preferably composed of a string contacting element which partially supports the string and distributes the contact pressures therefrom evenly over the entire area of an underlying pressure transducer element resting on a supporting base, so that the string vibrations will pass through the string contacting element to distort the pressure transducer element held between the contacting element and the base.

Each half of the pickup is most sensitive to pressures which are applied in the direction of maximum sensitivity of the pressure transducer element. The pickup halves may be positioned at various angles between horizontal and almost vertical. For best results and for ease of manufacture, it has been found preferable to have the angle between the pressure transducer elements be either about 90 or 180 degrees. The 90 degree arrangement results in a better distribution of the pressures from the string to each pressure transducer element by reducing the shear forces applied to a first transducer element while exerting pressure on the other. This in turn increases the magnitude of the electrical signals produced and also increases the sensitivity of the pickup to planes of string vibration near the plane of minimum sensitivity.

The two juxtaposed halves of the pickup jointly form a string receiving notch and provide approximately equal support to the contacting string. The string contacting surface of each half of the pickup is preferably rounded or bulged to sharply delimit the length of the vibrating portion of the string.

Because the string contacting elements composing the string support do not have to match perfectly along their most proximate faces, both the dimensional and the angular tolerances of all parts of the pickup are significantly less stringent. This results in a pickup which is more economical to produce than would be the case if a single string support of the corresponding complex shape was used. This modular approach to the manufacture of the string support allows a first half of the pickup to be assembled and tested before the second half is added to the assembly, facilitating rework when it is required.

The simple shape of each string contacting element of the pickup allows a choice of processes for its manufacture and also allows hard materials to be used economically in its construction, thus reducing the absorption of high frequencies in the contacting element, preventing permanent deformations of the string contacting surface and significantly reducing the magnitude of the shear forces applied to the pickup by the string when its tension is greatly varied either by tuning it or when a vibrato tailpiece is being used.

In a first embodiment, a pair of semi-cylindrical pressure transducers of the piezoelectric type angled at about 90 degrees from each other directly support the contacting string.

In a second embodiment, the pickup halves are also angled at 90 degrees from each other and each pressure transducer supports a string contacting element having a rounded string contacting surface.

In a third embodiment, the two halves of the pickup rest on a massive element which is resiliently coupled to the supporting base.

In a fourth embodiment, both halves of the pickup lie in the same plane and the pressure transducers support string contacting elements of truncated conical form which are retained sideways by abutments in order to hold the pickup halves together.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings wherein.

DETAILED DESCRIPTION OF THE PREFERRED EMBODIMENT

Figure 1:
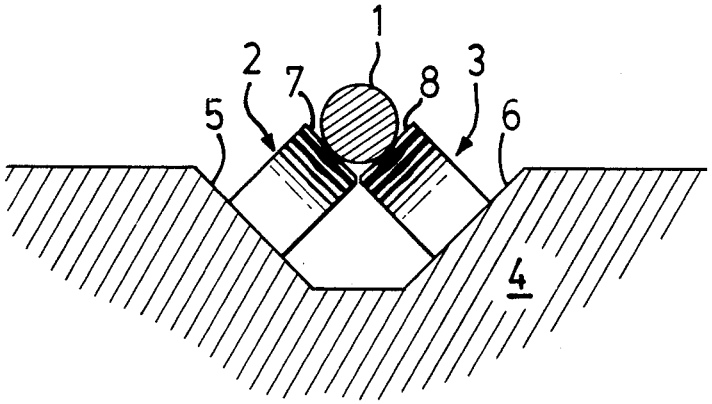
FIG. 1 is a front view of a first embodiment of a pickup according to the present invention.

Referring now to the drawings, FIG. 1 is a front view of a first embodiment of a pickup according to the present invention in which a pair of pressure transducers 2 and 3 having rounded string contacting surfaces 7 and 8, directly support the string 1 in a transversal manner and rest on the supporting faces 5 and 6 of a common base 4, also seen in cross-section. The string contacting surfaces 7 and 8 are rounded in order to sharply delimit the length of the vibrating portion of the string 1 and also allow the vibrating string to slip over them when its tension is varied. The angle between the pressure transducers 2 and 3 is approximately 90 degrees which corresponds to the angle between the supporting faces 5 and 6 of the base 4. The pressure transducers 2 and 3 must be positioned close enough to each other so that the string 1 will remain abutted on the string contacting surfaces 7 and 8. The string preferably contacts the center of each contacting surface so that the direction of maximum sensitivity of the corresponding pressure transducer will be an extension of the radius of the string. This positional relationship between the pressure transducers and the contacting string optimizes pickup sensitivity to the string vibrations. When the string 1 is brought to tension, the static pressure exerted by the string as it is streched over the pickup tends to compress the pressure transducers 2 and 3 in different directions and thus separate them slightly, depending on their compliance.

The signal from a pressure transducer is proportional to the vector of the plane of vibration in the direction of maximum sensitivity of the transducer. Two transducers can therefore be oriented with respect to each other so that their combined output will be the same in more than two planes of vibration. For example, the joint vertical sensitivity of a pair of in-phase transducers depends on their orientation with respect to the string and also with respect to each other. If the transducers are almost vertical, very little output will be generated. As they are oriented gradually towards the horizontal plane, an angle will be found in the vicinity of 90 degrees, where the joint sensitivity to string vibrations will be the same in three planes of vibration. The planar response may be established in this way to best capture the planes of the desirable string vibrations encountered in a given instrument.

When the string is vibrating, it tends to rock one transducer while exerting pressure on the other; the string also tends to rotate very slightly on itself as a result of the resistance of the rocked transducer to the rocking motions. This in turn slightly rocks the transducer to which the pressure is being applied, and the net effect of these interactions is a reduction in the magnitude of the shear forces applied to the transducer elements. Since the string 1 can apply pressures in different directions simultaneously and roll slightly on the contacting surfaces 7 and 8 of the pickup to accomodate for the slight compliance of the supporting elements 2, 3 and 4, a greater proportion of the string vibrations may be converted into electrical signals, increasing transduction efficiency.

When a shear force is applied to a pressure transducer in a direction approximately perpendicular to its direction of maximum sensitivity, a voltage of opposite polarity is generated. That is, a transducer generating a positive voltage in response to a positive pressure in the direction of maximum sensitivity will generate a negative voltage in response to a shear force applied in a direction perpendicular to the direction of maximum sensitivity of the transducer. This occurs because the shear force tends to distend the entire element.

A rocking motion, on the other hand, will generate approximately zero output since the transducer is distended over about one half of its active area while the remaining portion of the area is compressed. This characteristic of the pickup is desirable since it reduces the amount of signal cancellation between the pressure transducers. This tends to increase the pickup's response to vibrations in planes near the horizontal plane, where the rocking effect is greatest in both transducers simultaneously. The effect is noticeable mostly when the horizontal plane is the plane of minimum sensitivity.

Figure 2:
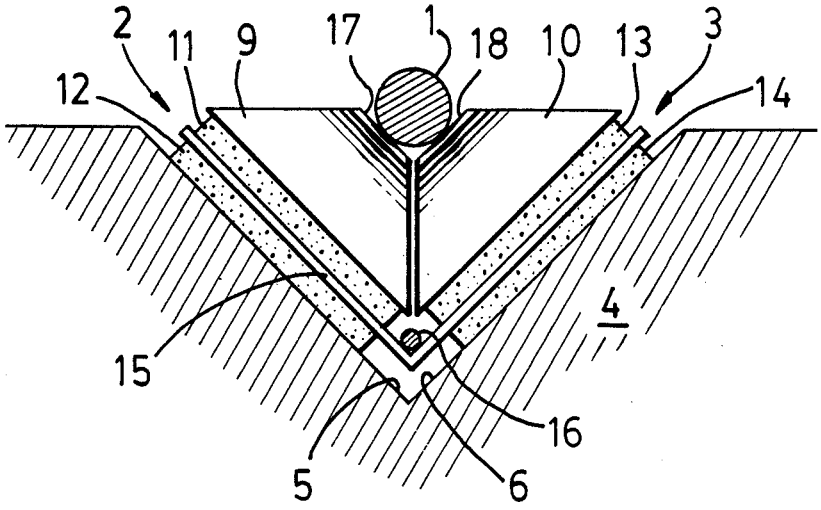
FIG. 2 is a front view of a second embodiment of a pickup according to the present invention.
Figure 3:
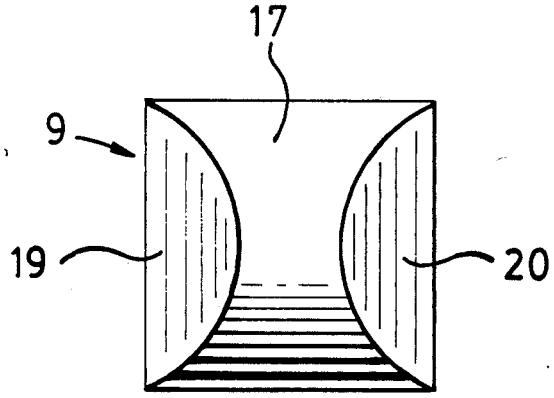
FIG. 3 is a plan view of a string contacting element used in the pickup of FIG. 2.

FIG. 2 shows a second embodiment of a pickup according to the present invention where pressure transducers 2 and 3 share a common conductor element 15 which contacts four piezoelectric pressure transducer elements 11, 12, 13 and 14. Superposed piezoelectric elements 11 and 12 of pressure transducer 2 present an electrode of the same polarity to the conductor element 15. This is also the case of superposed elements 13 and 14 of pressure transducer 3. A lead 16 connected to the conductor element carries the pickup signal to utilisation means. This configuration has the advantage of being possibly self-shielding and also has some noise cancelling qualities in that it presents two edges of inverse polarity to interference fields. Although a single conductor element 15 is illustrated in the embodiment of FIG. 2, separate conductor elements may be used for each pair of superposed transducer elements in order to obtain separate signals therefrom, if desired. The conductor element 15 should be incompressible but it may be flexible, especially in the region between the transducer elements. In this embodiment, the pressure transducers generally designated 2 and 3 support string contacting elements 9 and 10 which have rounded string contacting surfaces 17 and 18. FIG. 3 shows a detailed view of a string contacting element of the type used in the second and third embodiments of the present invention. The string contacting surfaces 17 and 18 may be electrically conductive and may be connected to an electrode or to a terminal of their respective underlying pressure transducers 2 and 3, and if a conductive string 1 is used, the string 1 may provide an electrical connection between the string contacting surfaces 17 and 18, possibly eliminating the need for separate electrical conductors therefrom.

Figure 4:
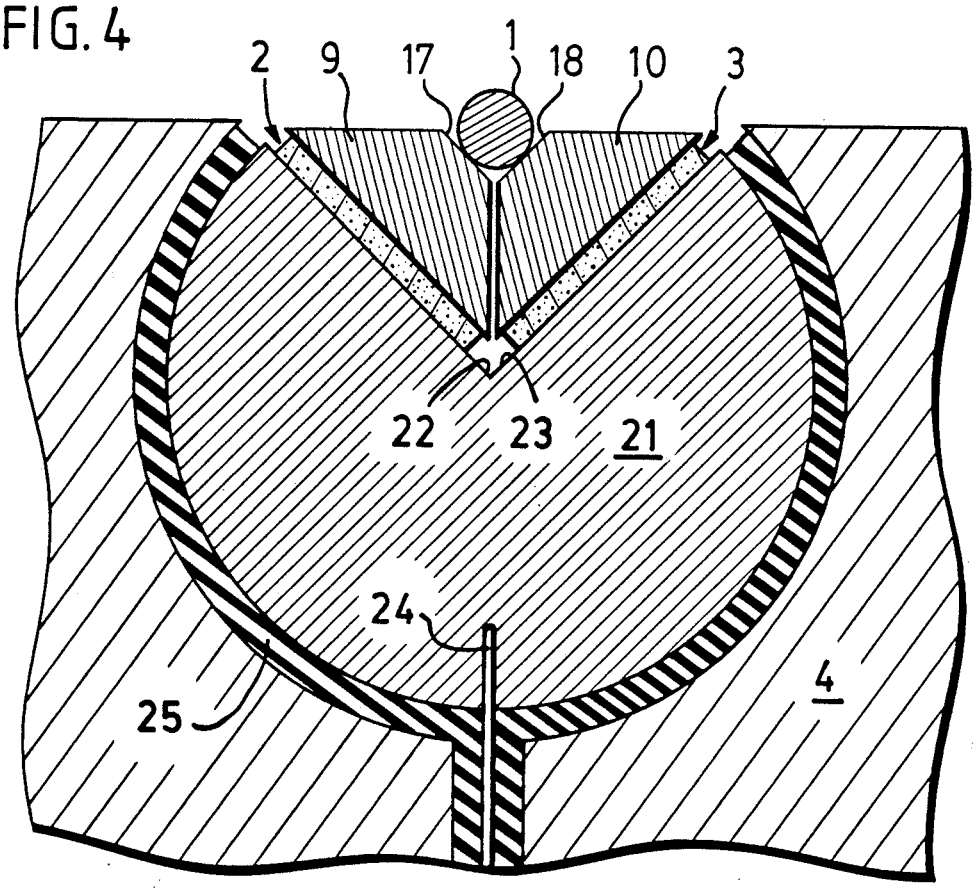
FIG. 4 is a section view of a third embodiment of a pickup according to the present invention.

In the embodiment of FIG. 4, the two halves of the pickup are shown resting on a massive element 21 supported by resilient material 25 in order to mechanically insulate the pickup from the supporting base 4, and thus minimize string-to-string crosstalk. The massive element 21 may be conductive and it may be used as a conductor element. A lead 24 is used to connect the conductive massive element 21 to utilisation means. The lead 24 may be stiff in order to determine the orientation of the pickup. If the massive element is to be at the same voltage potential as the surface supporting it, for example when using the transducer configuration of FIG. 2 in conjunction with a massive element, the resilient material 25 or a part thereof may be electrically conductive and serve as a part of the conductive means to connect a portion of the pickup to utilisation means. String contacting elements 9 and 10 are prefereably hard and incompressible in order to prevent the string 1 from biting into the string contacting surfaces 17 and 18, and also for best pickup response and best string sustain in the high frequencies.

Figure 5:
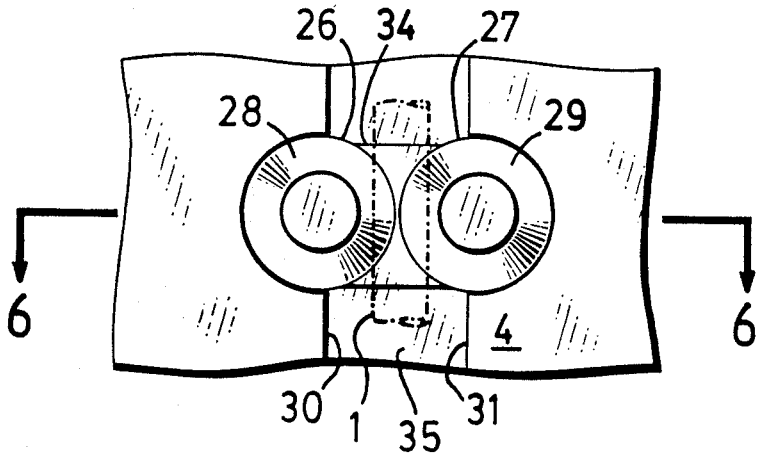
FIG. 5 is a plan view of a fourth embodiment of a pickup according to the present invention.
Figure 6:
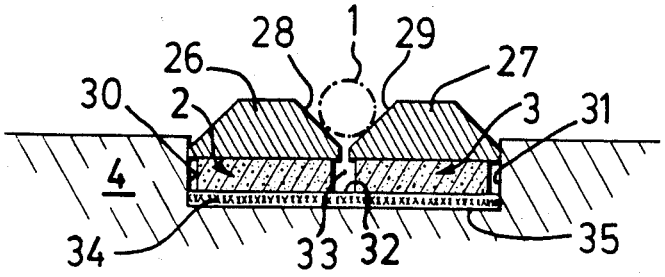
FIG. 6 is a section view of the pickup of FIG. 5.

FIGS. 5 and 6 respectively show a plan view and a side section view of a fourth embodiment of a pickup according to the present invention where the pressure transducers 2 and 3 lie in a common plane. The pressure tranducers 2 and 3 respectively support string contacting elements 26 and 27 which are abutted respectively on retaining walls 30 and 31 created by a depression 33 practiced in the base 4. The depression 33 acts as a holding cavity which prevents the string 1 from applying shear forces which would tend to displace the two halves of the pickup. Pressure transducers 2 and 3 rest on the supporting face 32 of an insulator element 34 which rests on the bottom face 35 of an electrically conductive base 4. String contacting elements 26 and 27 are also electrically conductive and they provide an electrical connection between the base 4 and one electrode of each transducer element. This simplifies the construction of the pickup and thus helps reduce its cost. The friction between the retaining walls 30 and 31 and the string contacting elements 26 and 27 is preferably low to prevent the string contacting elements 26 and 27 from functioning as cantilevers, which may alter both the planar response and the magnitude of the electrical signal produced by the pickup. For this purpose, lubricating means or other friction reducing means may be used between the string contacting elements 26 and 27 and the walls 30 and 31. These friction reduction means may possibly be electrically conductive to ensure electrical continuity between the string contacting elements 26 and 27 and the walls 30 and 31, if desired.

In all of the embodiments described herein, an electrically conductive string may serve as the ground lead for both string contacting elements simultaneously. This reduces the mass of the pickup by eliminating conductors normally connected thereto and makes the pickup more economical to manufacture.

Whenever it was possible in this description, the conductive means to connect the pressure transducers to utilisation means have been omitted for clarity.

While the present invention has been described with respect to the preferred embodiments in accordance therewith, it will be apparent to those skilled in the art that various modifications and improvements may be made without departing from the scope and spirit of the invention. For example, although the pressure transducers are herein described and illustrated in FIG. 2 as piezoelectric elements, other pressure sensitive devices such as piezoresistive elements, capacitive elements, pressure sensitive semiconductors or a combination thereof may be used in pickups of the present invention. Accordingly, it is to be understood that the invention is not to be limited by the specific illustrative embodiments, but only by the scope of the appended claims.

What is claimed is:

1. A pickup for a vibratable string of a musical instrument, said pickup comprising:

first pressure transducer means for contacting a first point of said vibratable string and for providing support to said first point in a first direction of vibration of said vibratable string, and second pressure transducer means, separate from said first pressure transducer means, for contacting a second point of said vibratable string transversly adjacent from said first point, and for providing support to said second point in a second direction of vibration of said vibratable string different from said first direction, whereby said first and said second pressure transducer means provide independent support to said vibratable string.

2. The pickup of claim 1 wherein a point of each of said first and second pressure transducer means contacting said vibratable string is rounded.

3. The pickup of claim 1 further comprising:

a massive element contacting said first and said second pressure transducer means and providing support thereto in said first and in said second direction of vibration of said vibratable string and resilient supporting means for said massive element, whereby said massive element supporting said first and said second pressure transducer means is mechanically coupled to a portion of said musical instrument supporting said pickup through said resilient supporting means.

4. The pickup of claim 3 wherein said resilient supporting means for said massive element are electrically conductive and provide an electrical connection between a part of said pickup and utilisation means.

5. The pickup of claim 1 wherein said vibratable string provides an electrical connection between said first and said second pressure transducer means.

6. The pickup of claim 1 wherein said first and said second pressure transducer means are positioned with respect to one another in such manner that said pickup has an equal sensitivity in three planes of vibration of said vibratable string.

7. The pickup of claim 1 wherein said first and said second pressure transducer means are separated by a distance determined by a first force applied by means of said vibratable string to said first pressure transducer means, and by a second force applied by means of said vibratable string to said second pressure transducer menas.

8. The pickup of claim 1 wherein a means to conduct a signal from said pickup to utilisation means is a means to maintain a fixed orientation of said pickup.

* * * * *